US006929095B2

(12) United States Patent
Brygger

(10) Patent No.: US 6,929,095 B2
(45) Date of Patent: Aug. 16, 2005

(54) ROLL-UP STABLIZER

(76) Inventor: Carl H. Brygger, 301 Harbor Heights Dr., Lexington, SC (US) 29072

( * ) Notice: Subject to any disclaimer, the term of this patent is extended or adjusted under 35 U.S.C. 154(b) by 0 days.

(21) Appl. No.: 10/676,069

(22) Filed: Oct. 2, 2003

(65) Prior Publication Data

US 2005/0072629 A1 Apr. 7, 2005

(51) Int. Cl.[7] ..... E04G 5/02; E06G 7/06; E06G 7/14

(52) U.S. Cl. ..... 182/107; 182/214; 248/210

(58) Field of Search ..... 182/107, 214, 182/108, 129, 13–17, 116, 20, 22, 165; 248/210, 248/211, 238

(56) References Cited

U.S. PATENT DOCUMENTS 1,004,284 A 9/1911 Lehmann
1,447,092 A 2/1923 Larson
2,597,902 A 5/1952 Roketa
3,773,143 A * 11/1973 Del Prete et al. ..... 182/214
4,049,283 A * 9/1977 Brookes et al. ..... 182/127
4,580,660 A * 4/1986 Oling ..... 182/107
4,754,843 A 7/1988 Anderson
4,938,312 A * 7/1990 Trail ..... 182/214
6,276,490 B1 * 8/2001 Swanick, Jr. ..... 182/107

* cited by examiner

*Primary Examiner*—Hugh B. Thompson, II
(74) *Attorney, Agent, or Firm*—Richard C. Litman

(57) ABSTRACT

The roll-up stabilizer includes an elongated aluminum stabilizer bar that is square in cross-section. The bar is U-shaped and is bent at both ends to form the arms of the "U". Each arm has a curved portion and a straight portion. An axle for a wheel is welded or otherwise attached to the end of the straight portion of each arm and a wheel is rotatably secured to each axle. A sheet metal trough is affixed to the central part of the middle portion of the bar by welding or other suitable fasteners. The trough is shaped to hook over and center the stabilizer bar upon the top rung of a ladder. Toggle clamps are secured by welding or other suitable fasteners to the stabilizer bar or to tubular sliding members on the stabilizer bar in position to secure the bar to the base of a ladder rail that is I-shaped in cross-section in a position adjacent the top rung of the ladder.

16 Claims, 5 Drawing Sheets

ROLL-UP STABLIZER

BACKGROUND OF THE INVENTION

1. Field of the Invention

The present invention relates to attachments for ladders and more specifically to ladder stabilizers.

2. Description of the Related Art

Many devices have been designed in the past to assist in moving single section or multiple section ladders to different elevations along the walls of buildings. For example, the U.S. Pat. No. 4,754,843 issued Jul. 5, 1988 to Anderson teaches clamping a roller at the top of a ladder. Support arms rotatably support the axle of the roller. Each support arm includes a recess at its distal end for attachment to the top rung of the ladder. The support arms are secured to the rails of the ladder by nuts and bolts. Anderson has the distinct disadvantage of not being able to support the ladder before an opening such as a window or door.

In U.S. Pat. No. 1,004,284 issued Sep. 26, 1919 to Lehmann, an adjustable ladder support is taught for attachment the top rung of a ladder. The support is formed with many sliding members to enable the rollers of the support to be extended outwardly from the ladder to support the ladder around windows and doors. Other adjustable portions of the support of the Lehmann device are provided for adjusting the distance between the ladder and the building wall. These other adjustable portions are configured for attachment to a second selected rung of the ladder. Not only does Lehmann suffer the disadvantage of having numerous parts but also it further requires the use of two rungs of a ladder. The U.S. Pat. No. 2,597,902 issued May 27, 1952 to Roketa functions in a manner similar to the Lehmann device but does so using different structural components. The ladder rest of Roketa is also used for straddling doors and windows. The device of Roketa also has the disadvantage of having to use multiple clamping devices to attach the device to multiple rungs and the rails of the ladder.

U.S. Pat. No. 1,447,092 issued Feb. 27, 1923 to Larson teaches a ladder attachment in the form of a single rod having a middle portion formed to frictionally grip a round ladder rung. Arms extend outward from the middle portion and each side of the ladder. At the end of each arm a roller is rotatably mounted on the end of the arm with washers and cotter-type pins. With the middle portion affixed to the ladder rung the arms rest against the rails of the ladder. A hook is pivotally mounted on the rail of the ladder adjacent to the arm of the rod so as to secure the arm in position against the rail. Larson is silent on supporting the ladder over windows and doors. Larson also requires that a hook be permanently mounted on a ladder rail to secure the device in position.

None of the above inventions and patents, taken either singly or in combination, is seen to describe the instant invention as claimed. Thus a ladder stabilizer device with wheels solving the aforementioned problems is desired.

SUMMARY OF THE INVENTION

The roll-up ladder stabilizer of the present invention includes an elongated aluminum stabilizer bar that is square in cross-section. The bar is bent at both ends to form arms having a curved portion and a portion that extends perpendicular to middle portion of the stabilizer bar. An axle for a wheel is welded or otherwise attached to the end of the perpendicular portion of the arm and a wheel rotatably secured to each axle. A sheet metal trough is affixed by welding or other suitable means to the central part of the middle portion of the bar. The trough is shaped to hook over a rung of a ladder. Also affixed to the middle portion of the bar outwardly from the trough are toggle clamps secured by welding or other suitable means. The clamps allow the stabilizer to be affixed to a ladder having rails that are I-shaped in cross-section. The clamps are positioned to secure the bar to the base part of the I-shaped rails.

Accordingly, it is a principal object of the invention to provide a roll-up stabilizer not having the disadvantage of having to use multiple clamping devices to attach the device to multiple rungs and the rails of the ladder.

It is another object of the invention to provide a roll-up stabilizer that doesn't require a permanent connection to the ladder.

It is also an object of the invention to provide a roll-up stabilizer that not only can be used for adjusting the extension of an extension ladder to a working height without the need of a second person to hold the ladder away from the wall while extending the ladder, but may also be used for rolling the ladder back and forth upon the ground from a storage place to the work place.

It is a further object of the invention to provide a roll-up stabilizer that enables a ladder to be supported before an opening such as a window or door.

Still another object of the invention is to provide a roll-up stabilizer that can be quickly and easily attached to and detached from a ladder.

A still further object of the invention is to provide a roll-up stabilizer that allows all the rungs of the ladder to be used and requires no drilling of holes in the ladder or the use of nuts and bolts to install the stabilizer.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
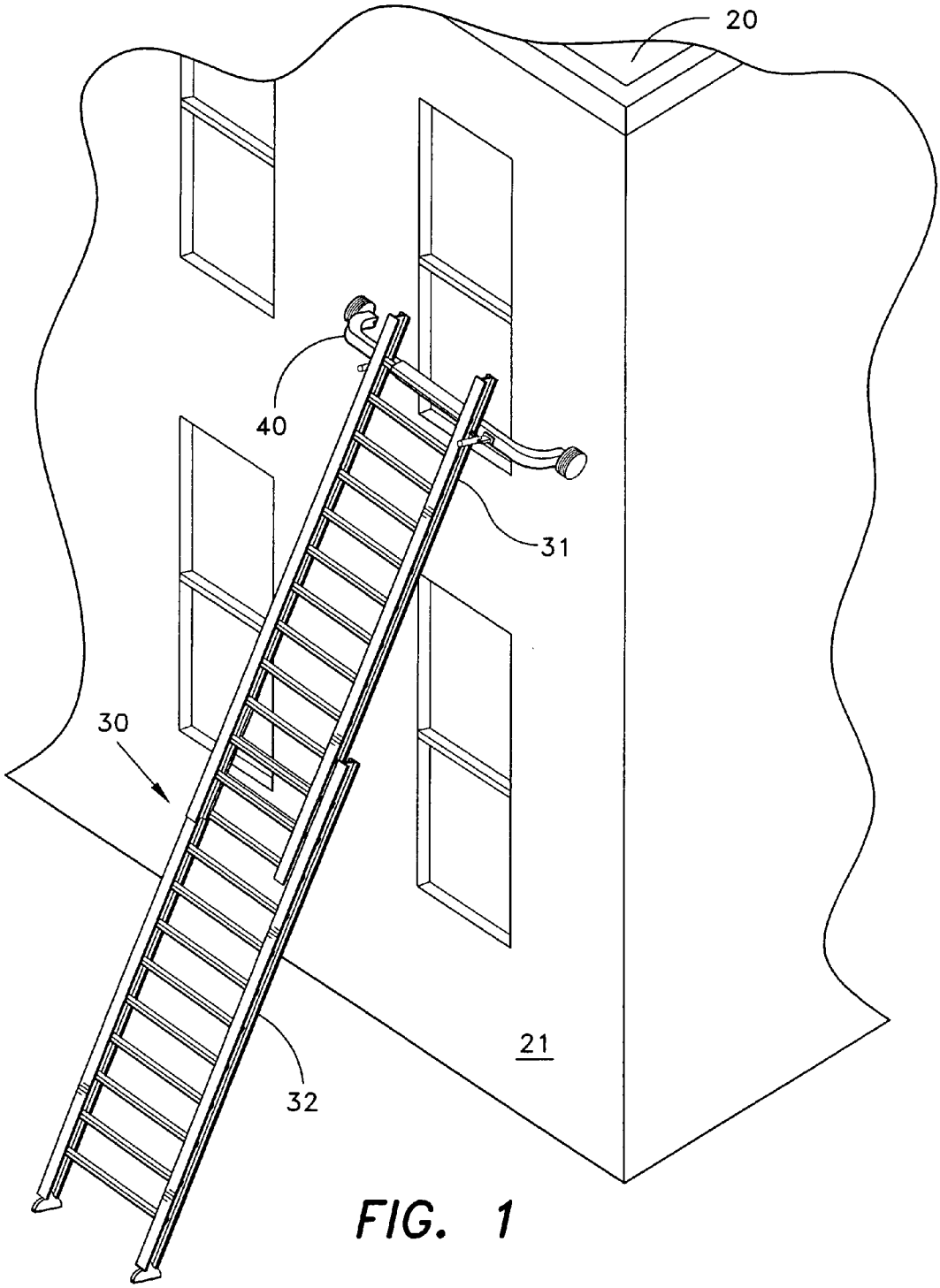
FIG. 1 is an environmental, perspective view of a roll-up stabilizer according to the present invention attached to an extendable ladder being positioned along a wall of a structure.

The present invention is a roll-up stabilizer for ladders. FIG. 1 shows the stabilizer 40 attached to the top rung of the extension portion 31 of an extension ladder 30. The base portion 32 of the ladder is positioned adjacent a wall 21 of a house or structure 20. The stabilizer includes wheels 43. The Wheels 43 of the stabilizer roll up the wall 21 as the ladder 30 is being extended to the working height. Preferably wheels have a diameter $d_1$ in the range from 3–8 inches, are constructed in a manner similar that of lawn mower wheels and formed of any suitable material for wheels including non-marking, more gripping or more stabilizing materials.

Figure 2:
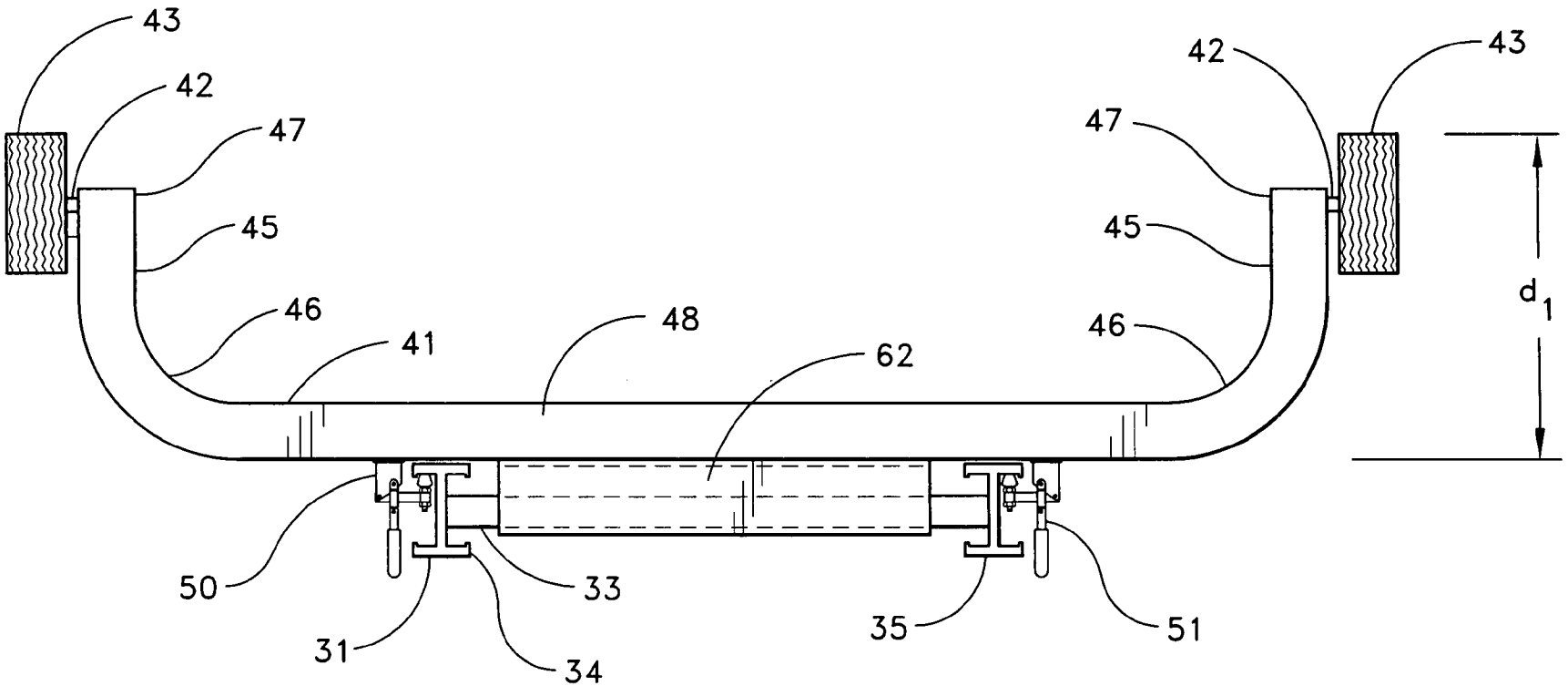
FIG. 2 is a top view of the roll-up stabilizer affixed to the top rung of a ladder.

Turning now to FIG. 2, the stabilizer 40 comprises an elongated tubular aluminum bar 48. Preferably the bar 48 is square in cross-section, however it may be rectangular, triangular, oval or other shape in cross-section. The ends 41 of the bar 48 are bent to give the bar 48 a U-shape with curved portions 46 connected to a straight leg portion 45. An axle 42 extends outwardly from the ends 47 of the straight leg portion 45 of the bar 48 for rotatably supporting wheels 43 secured thereto by any suitable means.

Also shown in FIG. 2 is the top rung 33 of the ladder that is attached at both ends to the rails 34, 35 of the extension portion 31 of the ladder 30. Rails 34 and 35 are I-shaped in cross-section. The back 61 of a hook-like trough 60 formed of sheet metal is welded to the top of the bar 48.

Figure 3:
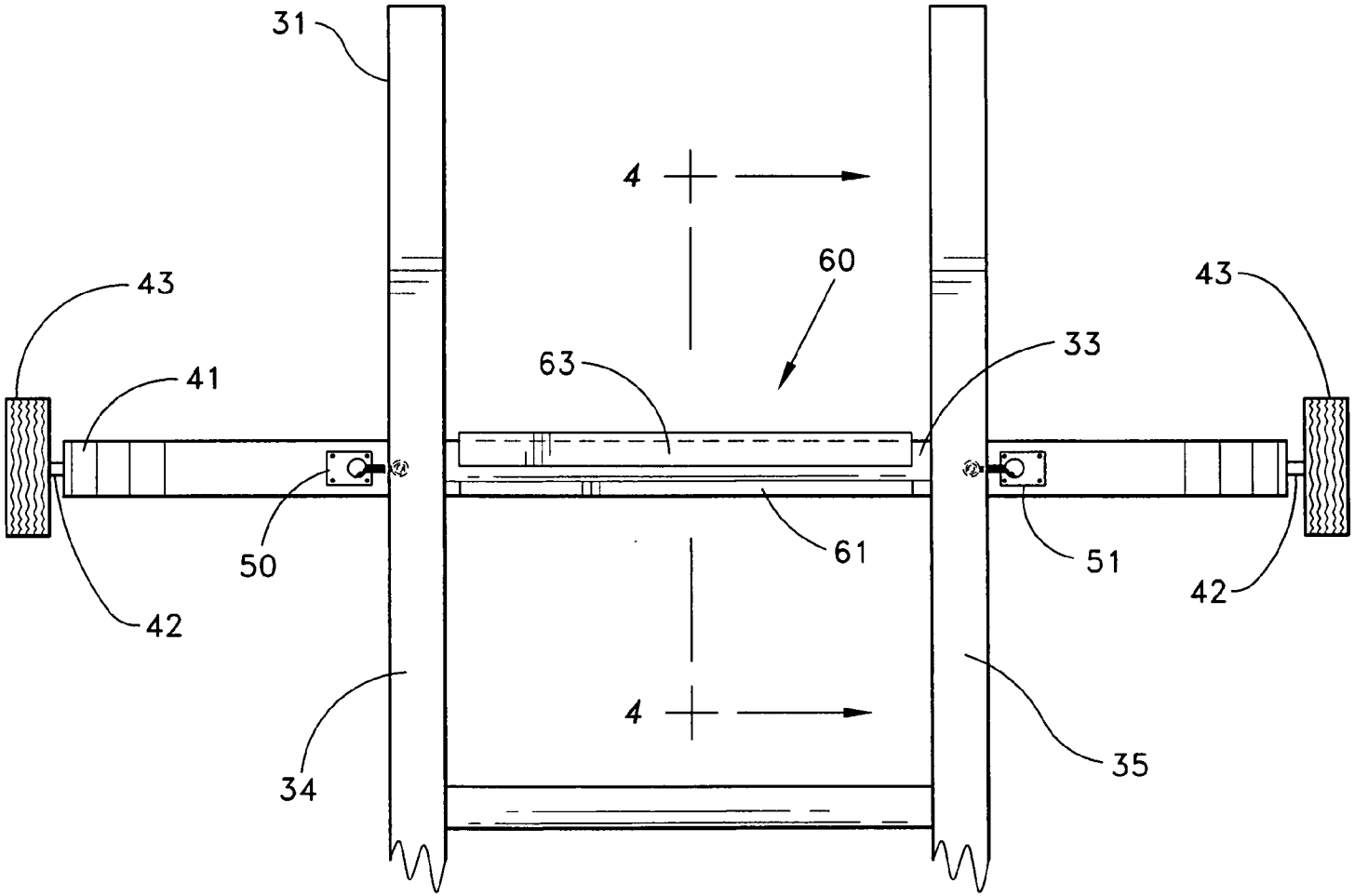
FIG. 3 is front view of the roll-up stabilizer of the present invention attached to a ladder.
Figure 4:
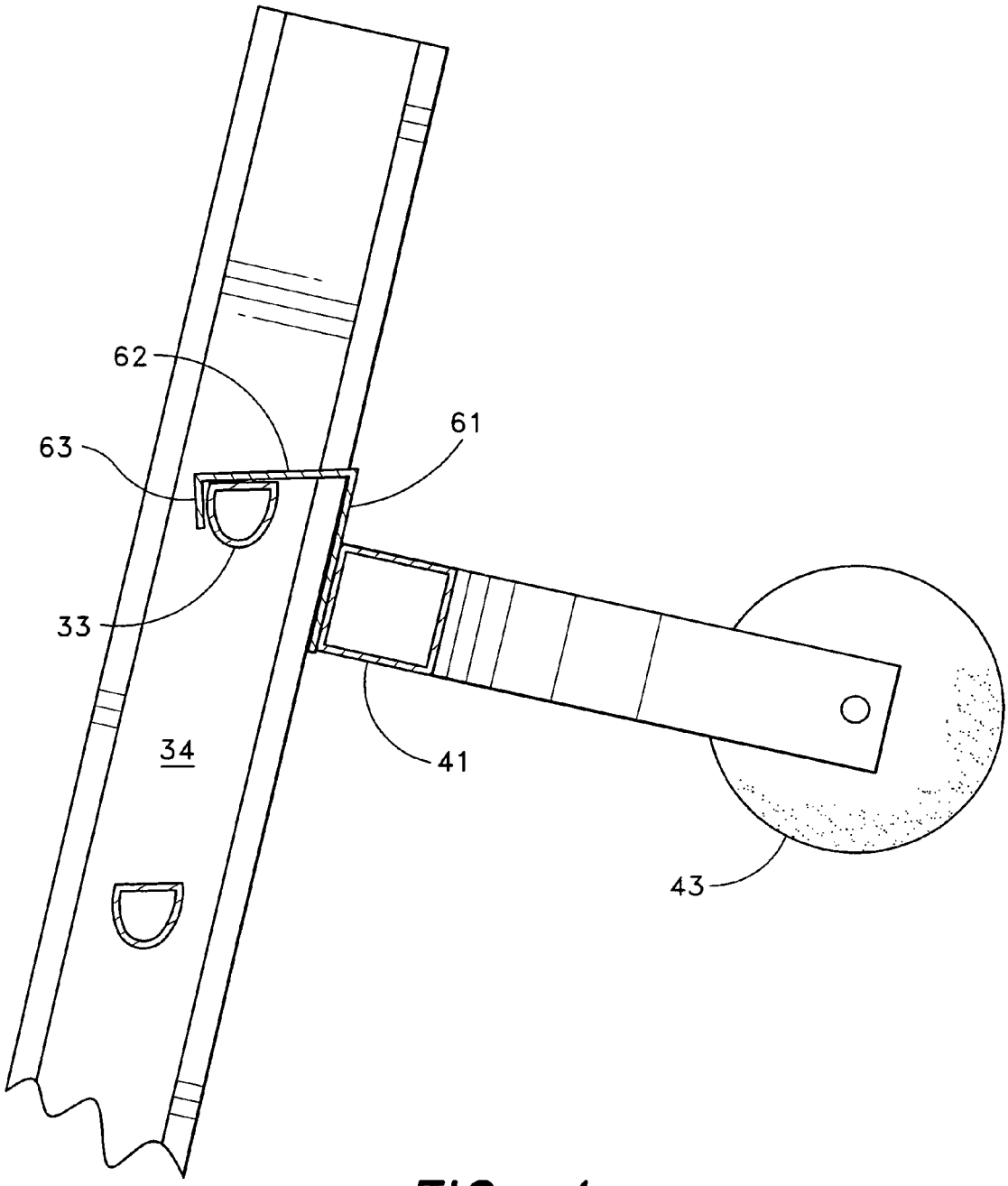
FIG. 4 is a cross-sectional view of the stabilizer bar in the direction 4—4 shown in FIG. 3.

As best seen in FIG. 4, the trough 60 includes a top portion 62 extending away from back 61 so as to cover the top rung 33 of ladder 30. A lip portion 63 extends downward from the top portion 62 so as to engage the front face of the ladder rung 33. FIG. 3 shows the lip portion 63 extending downwardly covering at least half of the thickness of the rung 33. Trough 60 serves as a means to center the stabilizer bar 48 upon the ladder rung 33 and in position for attachment to the ladder 30.

The means for attaching the stabilizer bar 48 is preferably in the form of commercially available clamping devices such as a Carr Lane Clamp type CL-250-VTC that has a holding force of at least 200 pounds. The clamping device may be a toggle type with vertical or horizontal locking, push-pull, self-locking, hydraulic or pneumatic. The clamps allow the stabilizer to be affixed to a ladder having rails that are I-shaped in cross-section. The clamps are positioned to secure the bar to the base part of the I-shaped rails.

The bases of the clamping devices 50, 51 are welded or otherwise secured to the top of the stabilizer bar 48. Clamping device 50 is positioned on bar 48 such that when the trough 60 is centered upon ladder rung 33 between the rails, the clamping portion of clamping device 50 can be clamped to the base part of the I-shaped ladder rail 34. Clamping device 51 is positioned on bar 48 such that when the trough 60 is centered upon ladder rung 33 between the rails, the clamping portion of clamping device 51 can be clamped to the base part of ladder rail 35. With clamping devices 50, 51 secured to the base part of the I-shaped ladder rails 34, 35 adjacent to top rung 33, the top of stabilizer bar 48 mounts flush with the rails and is firmly secured to the ladder.

Figure 5:
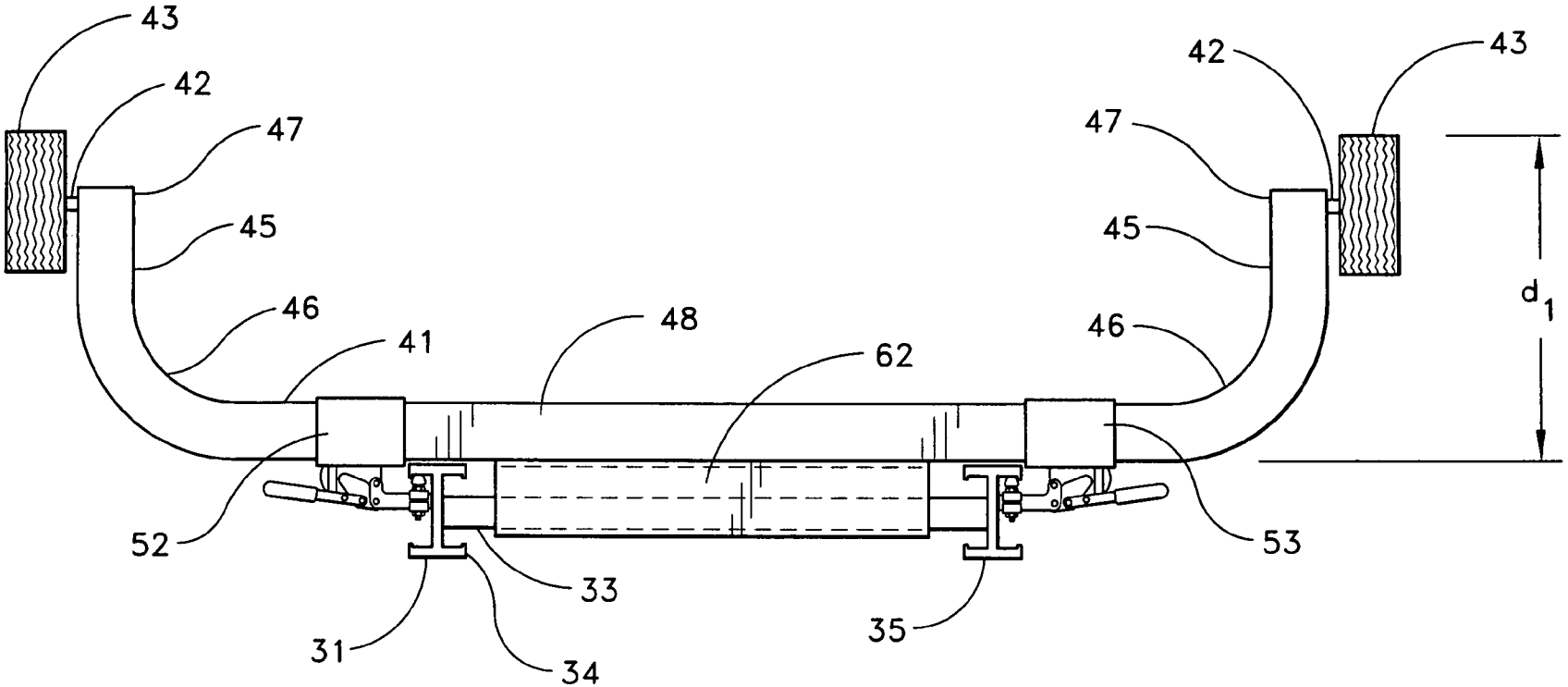
FIG. 5 is a top view of a second embodiment of the roll-up stabilizer attached to a ladder.

FIG. 5 shows a second embodiment of the roll-up stabilizer wherein clamping devices 50, 51 welded or otherwise secured to tubular metal sliding members 52, 53. Sliding members 52, 53 are movable along the stabilizer bar 48 to enable the roll-up stabilizer to be adjusted to fit ladders of different widths. When the trough 60 is centered upon ladder rung 33 between the rails 34, 35, sliding members 52, 53 are moved adjacent to the ladder rails 34, 35 where the clamping portion of clamping device 51 can be clamped to the base part of ladder rail 35. With clamping devices 50, 51 secured to the base part of the I-shaped ladder rails 34, 35 adjacent to top rung 33, the top of stabilizer bar 48 mounts flush with the rails 34, 35 and can be firmly secured in this manner to ladders of different widths.

It is to be understood that the present invention is not limited to the embodiments described above, but encompasses any and all embodiments within the scope of the following claims.

I claim:

1. A roll-up ladder stabilizer, comprising:

an elongated U-shaped stabilizer bar having an arm on each end, each arm having a curved portion and a straight end portion perpendicular to the base of the "U";

each straight end portion including an axle with a wheel rotatably attached to said axle;

means attached to said stabilizer bar for centering said stabilizer bar on a top rung of a ladder; and a pair of locking clamps welded to said stabilizer bar for securely clamping said stabilizer bar to a ladder adjacent to a top rung.

2. The ladder stabilizer of claim 1, wherein said wheels are between 3–8 inches in diameter.

3. The ladder stabilizer of claim 1, wherein said means for centering said stabilizer bar comprises a hook-shaped trough.

4. The ladder stabilizer of claim 1, wherein said stabilizer bar is square in cross-section.

5. The ladder stabilizer of claim 1, wherein said stabilizer bar is formed of aluminum.

6. The ladder stabilizer of claim 1, wherein the clamping means is adapted to secure the stabilizer bar to a base of an I-shaped rail adjacent to the top rung of the ladder.

7. A roll-up ladder stabilizer, comprising:

an elongated U-shaped stabilizer bar having an arm on each end, each arm having a curved portion and a straight end portion perpendicular to the base of the "U";

each straight end portion including an axle and a wheel rotatably attached to said axle;

means attached to said stabilizer bar for centering said stabilizer bar on a top rung of a ladder; and a pair of locking clamps welded to said stabilizer bar for securely clamping said stabilizer bar to a base of a pair of I-shaped rails of the ladder adjacent to a top rung of the ladder.

8. The ladder stabilizer of claim 7, wherein said means for centering said stabilizer bar comprises a hook-shaped trough.

9. The ladder stabilizer of claim 7, wherein said trough includes a back portion secured said stabilizer, a top portion adapted to extend over the rung of the ladder, and a lip portion adapted to extend downwardly over the rung of the ladder.

10. The ladder stabilizer of claim 9, wherein said wheels are between 3–8 inches in diameter.

11. The ladder stabilizer of claim 9, wherein said locking clamps have at least 200 pounds of clamping force.

12. The ladder stabilizer of claim 9, wherein said stabilizer bar is formed of aluminum and is square in cross-section.

13. A roll-up ladder stabilizer, comprising:

an elongated U-shaped aluminum stabilizer bar having an arm on each end, each arm having a curved portion and a straight end portion perpendicular to the base of the "U";

each straight end portion is provided with an axle and a wheel rotatably attached to each axle;

a hook-shaped trough is attached to the center of said stabilizer bar for centering said stabilizer bar on a top rung of a ladder, said trough comprising a back portion secured to said stabilizer bar, a top portion adapted to extend over the rung of the ladder, and a lip portion adapted to extend downwardly over the rung of the ladder; and means attached to said stabilizer bar for securely clamping said stabilizer bar to a pair of I-shaped rails of a ladder or ladder extension, said means for securely clamping being selected from the group consisting of a pair of locking clamps welded to said stabilizer bar and a pair of tubular sliding members with locking clamps secured thereon.

14. The ladder stabilizer of claim 13, wherein said wheels are between 3–8 inches in diameter.

15. The ladder stabilizer of claim 13, wherein said trough is formed of sheet metal.

16. The ladder stabilizer of claim 15, wherein said locking clamps have at least 200 pounds of clamping force and said wheels are between 3–8 inches in diameter.

* * * * *